US008622279B2

(12) United States Patent
Barnett

(10) Patent No.: US 8,622,279 B2
(45) Date of Patent: Jan. 7, 2014

(54) COOLER HAVING EDGE PROTECTED GRAPHICS SHEET

(76) Inventor: Sebastian Kaye Barnett, Weymouth (GB)

( * ) Notice: Subject to any disclaimer, the term of this patent is extended or adjusted under 35 U.S.C. 154(b) by 936 days.

(21) Appl. No.: 12/240,628

(22) Filed: Sep. 29, 2008

(65) Prior Publication Data

US 2010/0078441 A1 Apr. 1, 2010

(51) Int. Cl.
*B65D 81/00* (2006.01)

(52) U.S. Cl.
USPC ..... 229/87.01; 220/592.2; 206/459.5

(58) Field of Classification Search
USPC ..... 220/23.91, 908, 903, 694, 915.2, 915.1, 220/9.4, 592.2; 229/87.01; 206/457, 459.5; 215/12.1, 12.2, 13.1
See application file for complete search history.

(56) References Cited

U.S. PATENT DOCUMENTS

| | | | | |
|---|---|---|---|---|
| D259,760 | S | 7/1981 | Lucas et al. | |
| 4,341,091 | A | 7/1982 | Minter | |
| 4,662,188 | A | 5/1987 | Hullihan | |
| D329,001 | S | 9/1992 | Valentino | |
| 5,165,567 | A * | 11/1992 | Richardson et al. | 220/694 |
| 5,318,821 | A * | 6/1994 | Bradley, Jr. | 428/100 |
| 5,423,426 | A | 6/1995 | Harper | |
| D369,722 | S | 5/1996 | Lopez, Jr. et al. | |
| D386,649 | S | 11/1997 | Arnfelt | |
| 5,829,629 | A * | 11/1998 | Usher | 220/724 |
| D407,609 | S | 4/1999 | Rausch | |
| 6,000,985 | A * | 12/1999 | Yeh | 446/129 |
| D421,696 | S | 3/2000 | Hendrix | |
| D422,181 | S | 4/2000 | Birutis et al. | |
| D475,249 | S | 6/2003 | Cantor et al. | |
| D475,580 | S | 6/2003 | Cantor et al. | |
| 6,595,383 | B2 * | 7/2003 | Pietrantoni | 220/586 |
| D560,102 | S | 1/2008 | Sumter | |
| 2009/0173652 | A1 * | 7/2009 | Chen | 206/457 |

* cited by examiner

*Primary Examiner* — Stephen Castellano
(74) *Attorney, Agent, or Firm* — Dwayne E. Rogge; Schacht Law Office, Inc.

(57) ABSTRACT

Disclosed is an apparatus for storing articles. The apparatus comprises a container having an open top, a closed bottom and a continuous peripheral wall extending therearound between said top and bottom. The peripheral wall has an exterior surface adapted to have a flexible sheet applied thereto. The flexible sheet has top and bottom opposed edges corresponding to the top and bottom of the container. The apparatus further comprises edge protecting means for protecting at least one of the top or bottom edge of the flexible sheet.

21 Claims, 20 Drawing Sheets

COOLER HAVING EDGE PROTECTED GRAPHICS SHEET

BACKGROUND OF THE DISCLOSURE

1. Field of Disclosure

The present disclosure relates to containers in general and in particular to an insulated food storage container having protection for the edges of an applied graphics sheet.

2. Description of Related Art

Portable insulated containers, or coolers, as they are commonly referred to as are well known in the art. Conventional cooler construction comprises forming a blow molded outer shell. A vacuum formed inner liner is then placed within the outer shell and the space between the inner liner and outer shell may then be commonly filled with an expanding foam insulation. The inner liner and outer shell are typically connected to each other at their upper ends to sealably contain the insulation. The interior space defined by the inner line provides the storage space for food articles or the like and may be enclosed with a lid which may also be insulated.

Conventional coolers typically have a monochromatic outer shell which is the color of the material used to form that shell. As a result, coolers are typically not fully utilized for advertising or displaying of logos and graphics as are typical with other types of consumer products. For example, it is common for sports teams or schools to apply their logos to a variety of merchandise such as mugs, clothes, glasses and the like for sale to their supporters. Sales of such merchandise are often highly desirable both for enhancing the profile of the team as well as permitting these fans to demonstrate their support.

Several difficulties have heretofore limited the ability to apply graphics to the exterior surface of coolers. Cooler are required to be both relatively inexpensive to produce as well as rugged to cope with the impacts and rough treatment such products regularly endure. The rough treatment that coolers endure has limited the ability to apply paint or images directly to the cooler. Such paint would typically not endure the repeated abrasions of the surface of the cooler against various objects and would result in the paint becoming scrapped away in places and therefore visually unappealing. Additionally, the blow molding techniques typically utilized to form conventional coolers results in an uneven surface that is often inadequate for application of a paint or a graphics sheet thereto.

Additionally, graphic bearing sheets have also not previously provided an appropriate solution for applying graphics to coolers. Graphics sheets have edges which may be prone to being caught or hooked on objects. Therefore, any graphic sheets applied to a cooler needs to have these edges protected from such contacts. Previous methods of protecting these edges has been to recess a region into a single flat surface on the cooler body into which the graphics sheet may be applied. This method limits the graphics sheet to a single surface or requires multiple applications to surround the cooler resulting in a broken total image or excessive cost of manufacture. Such graphics sheets are also typically relatively small so as to provide sufficient space around the graphics sheet for the raised protectors. Graphics of this type have not been able to provide a single image that surrounds the entire body of the cooler.

SUMMARY OF THE DISCLOSURE

According to a first embodiment there is disclosed an apparatus for storing articles. The apparatus comprises a container having an open top, a closed bottom and a continuous peripheral wall extending therearound between said top and bottom. The peripheral wall has an exterior surface adapted to have a flexible sheet applied thereto. The flexible sheet has top and bottom opposed edges corresponding to the top and bottom of the container. The apparatus further comprises edge protecting means for protecting at least one of the top or bottom edge of the flexible sheet.

According to a further embodiment there is disclosed an apparatus for storing articles. The apparatus comprises a container having an open top, a closed bottom and a continuous peripheral wall extending therearound between said top and bottom. The peripheral wall has an exterior surface adapted to have a flexible sheet applied thereto. The flexible sheet has top and bottom opposed edges corresponding to the top and bottom of the container. The apparatus further comprises an edge protector for protecting at least one of the top or bottom edge of the flexible sheet.

The peripheral wall may have opposed top and bottom edges. The apparatus may further comprise at least one cap adapted to engage with one of the top or bottom edge of the peripheral wall wherein the at least one cap includes the edge protector. The edge protector of the at least one cap may be adapted to overlap at least a portion of the one of the top or bottom edge of the flexible sheet when the at least one cap is engaged with the peripheral wall.

The apparatus may further comprise a bottom cap adapted to engages the bottom edge of the peripheral wall and a top cap adapted to engage the bottom edge of the peripheral wall such that the edge protector of the bottom cap is adapted to overlap at least a portion of the bottom edge of the flexible sheet and the edge protector of the top cap is adapted to overlap at least a portion of the top edge of a flexible sheet applied to the peripheral wall.

The edge protector may be adapted to overlap the at least one of the top or bottom edge of the flexible sheet around a circumference of the container body. The edge protector may comprise a wall extending from the at least one cap and may be adapted to surround the container body in parallel to the peripheral wall. The edge protector may comprise a plurality of fingers extending from the at least one cap wherein the plurality of fingers are adapted to overlap the top or bottom edge of the flexible sheet.

The at least one cap may be adapted to have an edge located proximate to the at least one of the top or bottom edge of the flexible sheet when applied to the peripheral wall. The cap may be adapted to project outwardly from the peripheral wall farther than the flexible sheet.

The edge protecting means may comprise a raised portion of the peripheral wall located adjacent to the at least one of the top or bottom edge of the flexible sheet so as to project past the flexible sheet.

The apparatus may further comprise a flexible sheet for application to the peripheral wall. The flexible sheet may have inner and outer surfaces and top and bottom opposed edges corresponding to the top and bottom of the container such that at least one of the top or bottom edges of the flexible sheet is proximate to a corresponding top or bottom of the container. The flexible sheet may be sized such that the bottom edge of the flexible sheet is proximate to a bottom edge of the peripheral wall and the top edge of the flexible sheet is proximate to a top edge of the peripheral wall when applied thereto. The flexible sheet may be adapted to substantially surround the peripheral wall when applied thereto. The flexible sheet may further comprise a plurality of flexible sheet segments adapted to cooperate so as to circumferentially surround the peripheral wall. The inner surface of the flexible sheet may include an adhesive for application to the exterior surface of the peripheral wall.

The flexible sheet may comprise a substantially transparent material, wherein the flexible sheet further includes a graphic applied to the inner surface for viewing from the outer surface. The graphics may be printed onto the flexible sheet.

The top and bottom of the container may be parallel to each other wherein the peripheral wall extends perpendicularly therebetween. The top cap may further include a liner adapted to define an interior cavity of the container. The apparatus may further comprise an insulating layer between the liner and the peripheral wall.

According to a further embodiment there is disclosed a method of manufacturing a container for storing articles. The method comprises forming a continuous peripheral wall having top and bottom opposed edges and a peripheral wall having an exterior surface extending therebetween and applying a flexible sheet to the exterior surface. The flexible sheet has top and bottom opposed edges corresponding to the top and bottom edges of the peripheral wall. The method further comprises applying a bottom cap to the bottom edge of the peripheral wall and applying a top cap to the top edge of the peripheral wall. The bottom cap is adapted to overlap the bottom edge of the flexible sheet and the top cap is adapted to overlap the top edge of the flexible sheet.

BRIEF DESCRIPTION OF THE DRAWINGS

In drawings which illustrate embodiments wherein similar characters of reference denote corresponding parts in each view.

DETAILED DESCRIPTION

Figure 1:
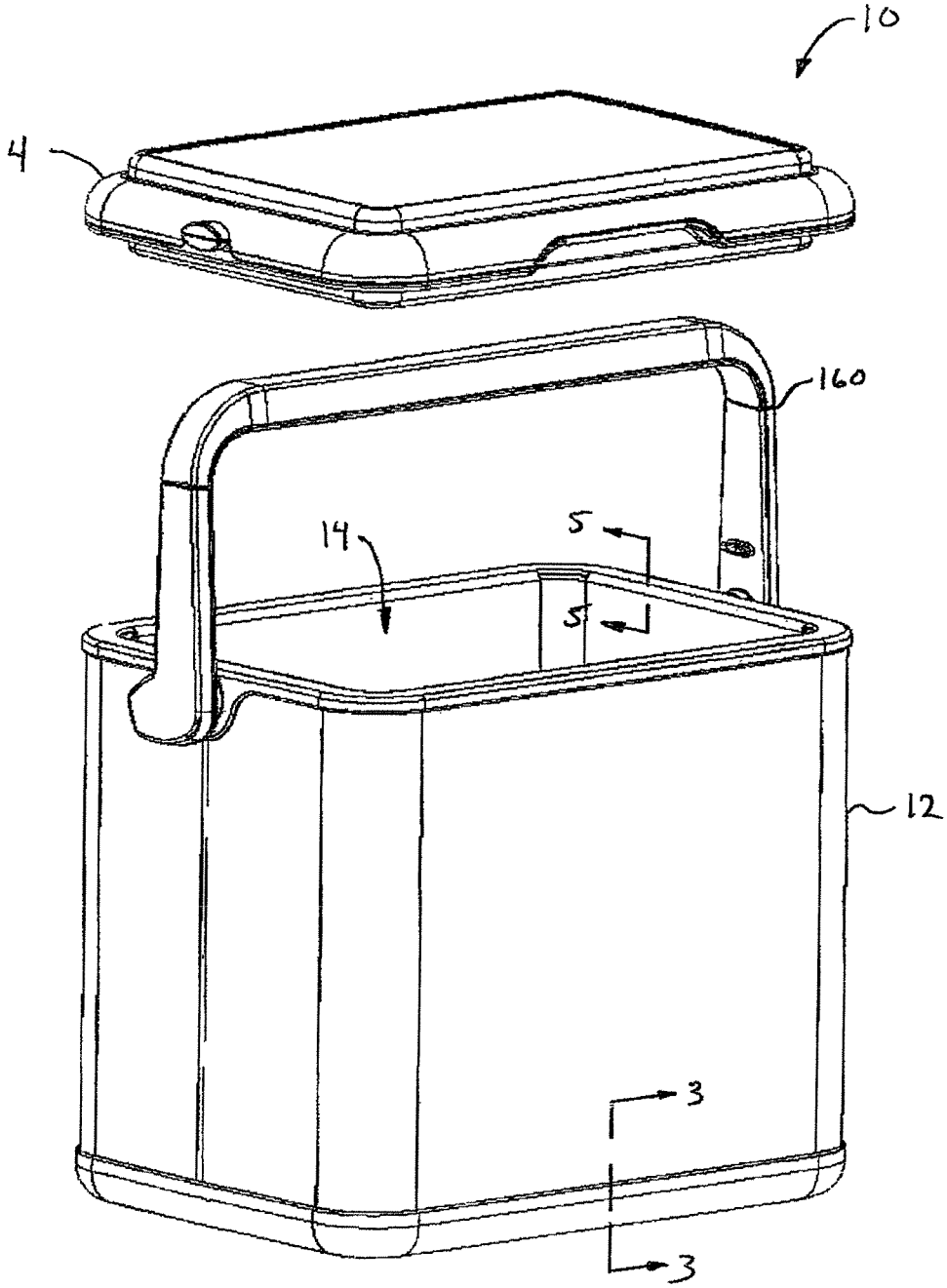
FIG. 1 is a front perspective view of a cooler according to a first embodiment having a cooler body and a lid.

Referring to FIG. 1, an insulated storage container or cooler according to a first embodiment as in illustrated at 10. The cooler 10 comprises a cooler body 12 having an interior compartment 14 for storing food and the like which is thermally insulated from the external environment. The cooler 10 may also optionally include a lid 4 sealably covering the interior compartment 14. The cooler 10 may also optionally include a rotatable handle 160 or other suitable handle means as are conventional and known in the art.

Figure 2:
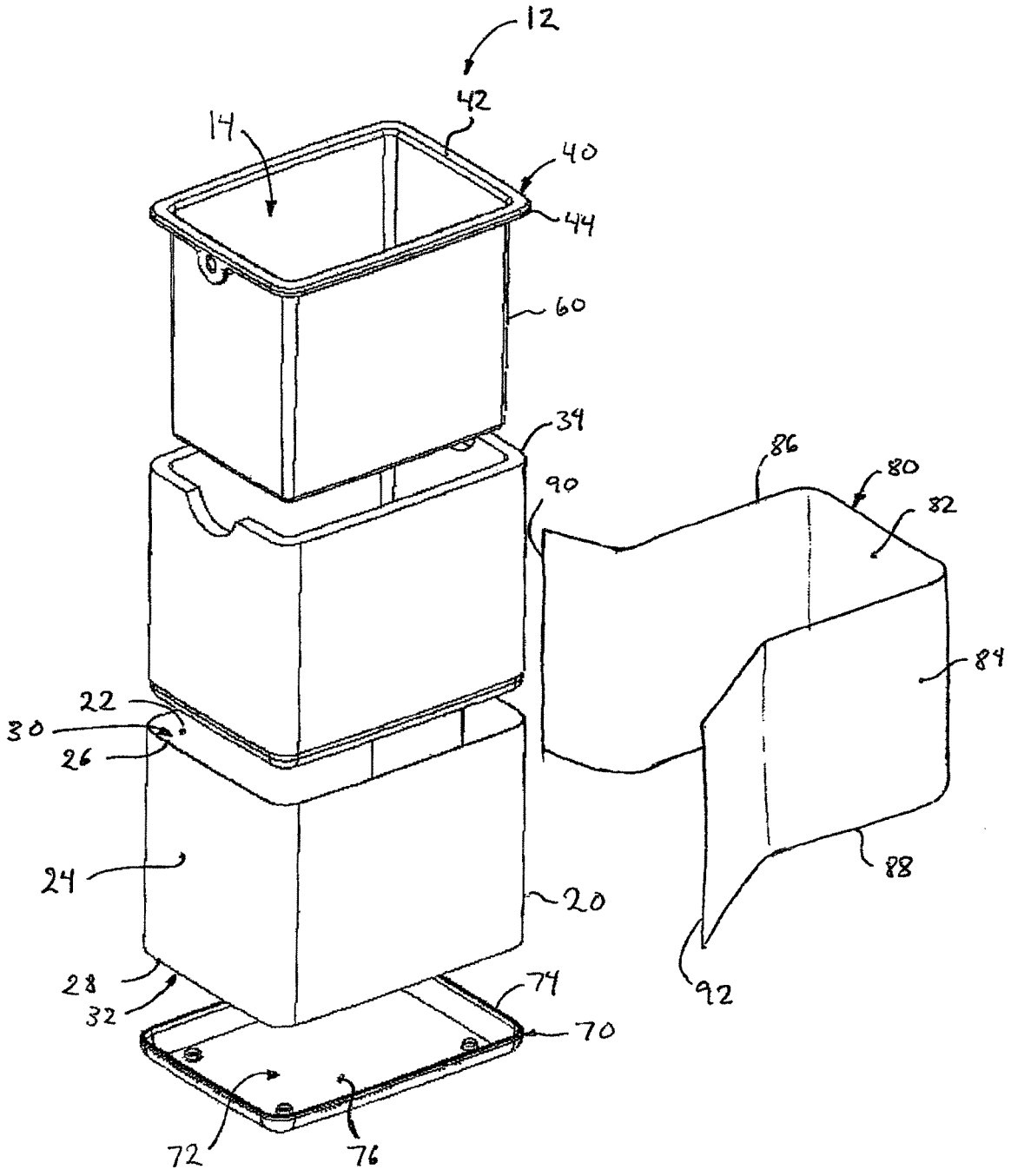
FIG. 2 is an exploded perspective view of the cooler body of FIG. 1.

Turning now to FIG. 2, an exploded view of the cooler body 12 according to a first embodiment is illustrated. The cooler body 12 comprises an upright continuous peripheral wall 20 having interior and exterior surfaces 22 and 24, respectively, extending between top and bottom edges, 26 and 28, respectively. As illustrated in FIG. 2, the peripheral wall 20 is arranged in a continuous loop such that the top edge 26 defines a top opening 30 and the bottom edge 28 defines a bottom opening 32. The cooler body 12 also includes top and bottom caps 40 and 70, respectively, sized and adapted to engage with the top and bottom edges 26 and 28 so as to enclose the corresponding top and bottom openings 30 and 32. According to the embodiment illustrated in FIG. 2, the top cap 40 may optionally include a continuously formed inner liner 60 therewith. In other embodiments, the inner liner 60 may be removably secured to the top cap 40 with fasteners or the like.

As illustrated in FIG. 2, the cooler body 12 is adapted to receive a flexible sheet 80 therearound having a back surface 82 and front surface 84. An adhesive, such as for example glue, double sided tape or epoxy or the like may be applied to the back surface 82 so as to adhere the graphic sheet to the exterior surface 24 of the peripheral wall 20. The back surface 82 of the flexible sheet 80 may have a graphics logo, or other type of visual display applied thereto that is visible to a viewer through the graphics sheet from the front surface 84. The graphics may be applied to the back surface 82 by means of direct printing on the back surface 82, ink-printing, photo sublimation printing, lithographic printing, screen printing, tempo or pad printing, foil blocking, inkjet printing, hand printing or any other suitable printable methods as are known in the art.

The flexible sheet 80 may be formed of any flexible material adapted to have a graphics applied thereto. According to some embodiments, the graphics may be applied to the back surface 82 of the flexible sheet 80. However it will be appreciated, that the graphics may also be applied to the front surface 84 or embedded or otherwise formed into the flexible sheet 80 material itself such as by way of direct printing on the front surface 84, photo sublimation printing, lithographic printing, screen printing, tampo printing, foil blocking, inkjet printing, and hand painting or any other suitable printable methods as are known in the art. Examples of suitable materials include, but are not limited to polycarbonate, polyvinyl chloride (PVC), acetate, polyester, polyethylene terephthalate (PET), glycol-modified polyethylene terephthalate (PETG), and acrylonitrile butadiene styrene (ABS) or high-impact polystyrene (HIPS). The flexible sheet 80 should also be selected to have sufficient toughness and thickness that it is not ripped or excessively damaged by impacts and abrasions. In practice, it has been found that a thickness of between 0.05 and 1 millimeters has been useful although it will be appreciated that other thicknesses will be useful as well.

The flexible sheet 80 comprises a substantially rectangular sheet of flexible material having top and bottom edges 86 and 88, respectively and first and second ends 90 and 92, respectively. The first and second ends 90 and 92 are adapted to be joinable to each other so as to form the graphics sheet into a sleeve for surrounding the peripheral wall 20. It will be appreciated that the length of the flexible sheet 80 will be selected so as to permit the flexible sheet 80 to closely surround the peripheral wall 20 when the first and second ends 90 and 92 are connected together. The first and second ends may be secured to each other by an adhesive, double sided tape, hot melting or any other suitable bonding method.

As illustrated in FIG. 2, the exterior surface 24 of the peripheral wall 20 extends between the top and bottom edges 26 and 28. In some embodiments, the exterior surface 24 extends perpendicular from the top and bottom edges 26 and 28 so as to facilitate the application of a rectangular graphics sheet thereto. It will be appreciated that in these embodiments, the exterior surface 24 will be substantially smooth and regular surface. Non-perpendicular surfaces may also be useful in embodiments in which the flexible sheet 80 is similarly adapted to be closely applied to the exterior surface 24. In such embodiments, the exterior surface 24 may have a taper from the top or the bottom edges 26 or 28 of the cooler body 12. As illustrated in FIGS. 1 and 2, the container body may have a substantially rectangular planar cross section with rounded or chamfered corners. It will be appreciated however cross-sectional shapes may also be possible such as circular, oval, triangular or octagonal by way of non-limiting example.

The peripheral wall 20 may be formed of any suitable material having a surface to which the flexible sheet 80 may be applied to, such as, without limitation, metals such as steel or aluminum, fiberglass, carbon fiber, or plastics such as polycarbonate, polyethylene, polypropylene or ABS. The exterior surface 24 should be formed to have sufficient strength to resist impacts and provide strength to the cooler. The selection of this thickness will depend upon the material to be used, however it has been found that a thickness of between 1 and 5 millimeters has been useful when the peripheral wall 20 is formed from polyethylene.

According to some embodiments, the height of the flexible sheet 80 between the top and bottom edges 86 and 88 will be selected to be close to but less than the height of the peripheral wall 20 between its top and bottom edges 26 and 28. In such a configuration, the flexible sheet 80 may be applied to the peripheral wall 20 such that the top edge 86 of the flexible sheet 80 is proximate to the top edge 26 of the peripheral wall. Correspondingly, the bottom edge 88 of the flexible sheet 80 will be proximate to the bottom edge 28 of the peripheral wall 20. Accordingly, the sizing of the top and bottom caps 40 and 70 should also be designed so as to properly protect the edges of the flexible sheet 80. In practice, it has been found that having a distance of less than 10 mm between the top edge 86 of the flexible sheet 80 and the top edge 26 of the peripheral wall 20 and a distance of less than 10 mm between the bottom edge 88 of the flexible sheet 80 and the bottom edge 28 of the peripheral wall 20 has been useful.

According to the present embodiment, an insulating material 34 may be disposed between the peripheral wall 20 and the inner liner 60. The insulating material 34 may comprise a preformed insulating shell as further described below, an injected expanding insulating material or other suitable means of providing thermal insulating between the inner liner and the peripheral wall and bottom cap as are known in the art.

The top cap 40 comprises an annular ring 42 having a distal downturned portion 44. The top cap 40 is adapted to have a shape and outline substantially proportionate to the top opening 30 such that the top cap 40 may be placed over the top edge 26 of the peripheral wall 20. When placed upon the top edge 26, the downturned portion 44 of the top cap 40 will overlap a portion of the peripheral wall 20 and form a void for protecting the top edge 86 of the flexible sheet 80 therebetween as described further below.

Figure 5:
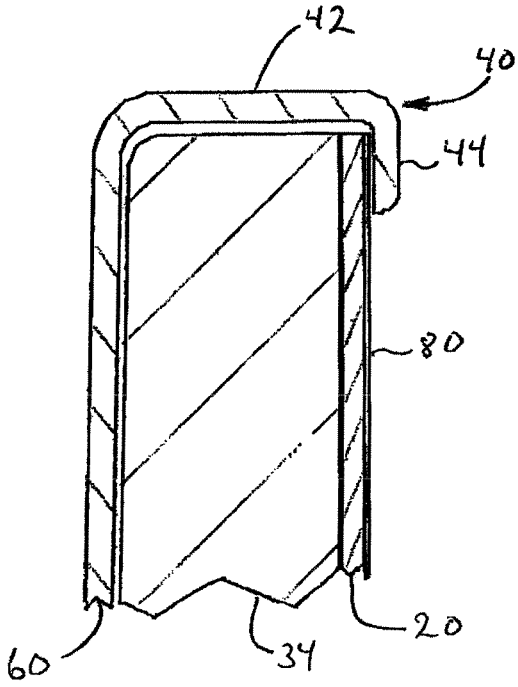
FIG. 5 is a detailed cross-sectional view of the top corner of the cooler body of FIG. 1 taken along the line 5-5 according to a first embodiment.

The downturned portion 44 may overlap the peripheral wall 20 and flexible sheet 80 by an amount sufficient to protect and retain the flexible sheet 80 against the peripheral wall 20 as illustrated in FIG. 5 which should be at least 1 mm. In practice it has been found that an overlap of between 3 and 15 millimeters of the downturned portion upon the flexible sheet 80 has been sufficient although other overlap distances will be useful as well.

The bottom cap 70 comprises a substantially planar member 72 having an upturned portion 74 extending around the around the perimeter thereof. The planar member 72 has top and bottom surfaces 76 and 78, respectively wherein the upturned portion 74 extends from the top surface 76.

The bottom cap 70 has an outline selected to correspond to the cross sectional area of the peripheral wall 20. When assembled, the bottom edge 28 of the peripheral wall 20 abuts against the top surface 76 of the bottom cap 70 such that the upturned portion 74 surrounds and overlaps a portion of the peripheral wall 20 to form a void for protecting the bottom edge 88 of the flexible sheet 80 therebetween as described further below.

The upturned portion 74 may overlap the peripheral wall 20 and flexible sheet 80 by an amount sufficient to protect and retain the flexible sheet 80 against the peripheral wall 20 which should be at least 1 mm. In practice it has been found that an overlap of between 3 and 15 millimeters of the upturned portion upon the flexible sheet 80 has been sufficient although other overlap distances will be useful as well.

The cooler body 12 may be assembled as illustrated in FIG. 2 by snugly locating the insulating material 34 within the peripheral wall 20. The flexible sheet 80 may then be applied to the exterior surface 24 of the peripheral wall 20 such that the top edge 86 of the flexible sheet 80 is proximate to the top edge 26 of the peripheral wall 20 and a bottom edge 88 of the flexible sheet 80 is proximate to the bottom edge 28 of the peripheral wall. The bottom cap 70 may then be secured against the bottom opening 32 formed by the bottom edge 28 of the peripheral wall 20 proximate to a bottom portion 36 of the insulating material 34. The top cap 40 having the inner liner 60 connected thereto may then be placed over and connected to the top edge of the peripheral wall 20 such that the inner liner is closely fitting with the inner surface of the insulating layer.

Figure 3:
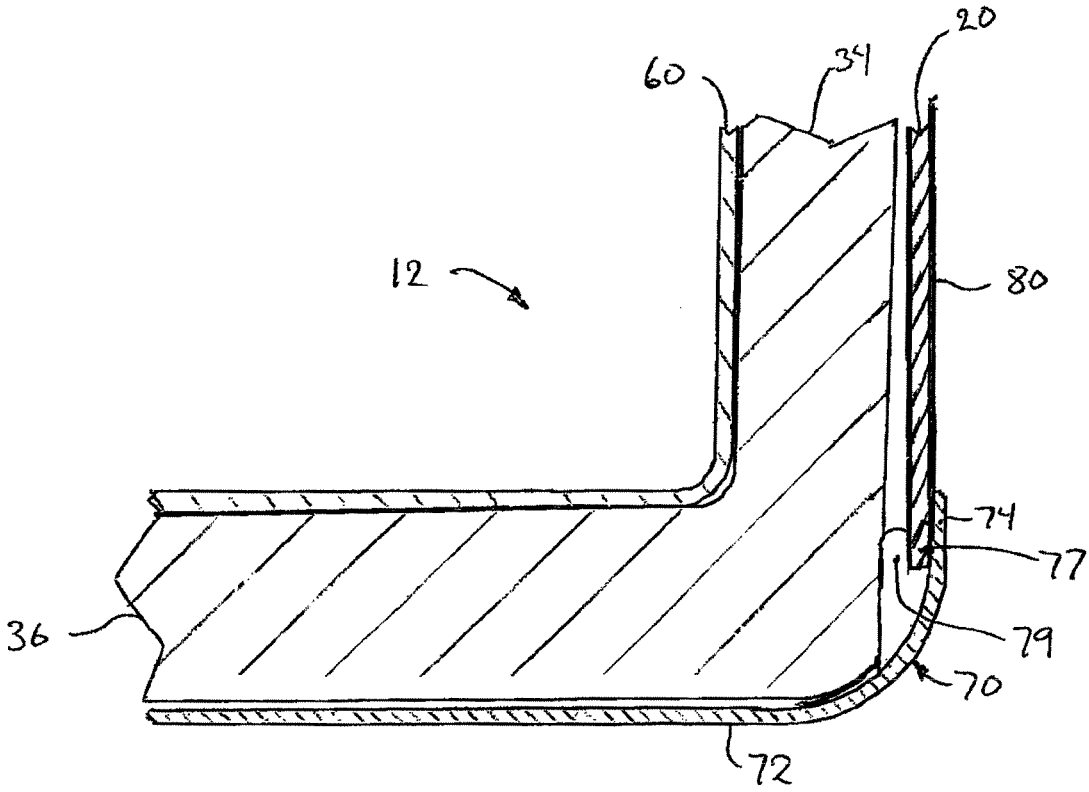
FIG. 3 is a detailed cross-sectional view of the bottom corner of the cooler body of FIG. 1 taken along the line 3-3 according to a first embodiment.

Turning now to FIG. 3, a detailed cross-sectional view of the bottom cap 70 applied to the peripheral wall 20 of the cooler body 12 showing peripheral wall control webs 79. The control webs 79 extend perpendicularly from the upturned portion 74 and include a notch 77 therein. As illustrated, the notch may be located proximate to the upturned portion 74 and is sized to receive the peripheral wall 20 and flexible sheet 80 therein. The notch 77 and control web 79 assist in stabilizing the bottom edge 28 of the peripheral wall 20 and with controlling flexing thereof. This will be particularly useful in embodiments where the peripheral wall 20 has a reduced thickness at the top and bottom edge 26 and 28, such as when it is formed as a single piece by injection molding. It will be appreciated that the notch 77 in the control webs 79 may also be located spaced apart from the upturned portion 74 so as to space the peripheral wall 20 and flexible sheet 80 inwardly from the upturned portion. It will also be appreciated, that the top cap 40 may also include similar control webs.

Figure 4:
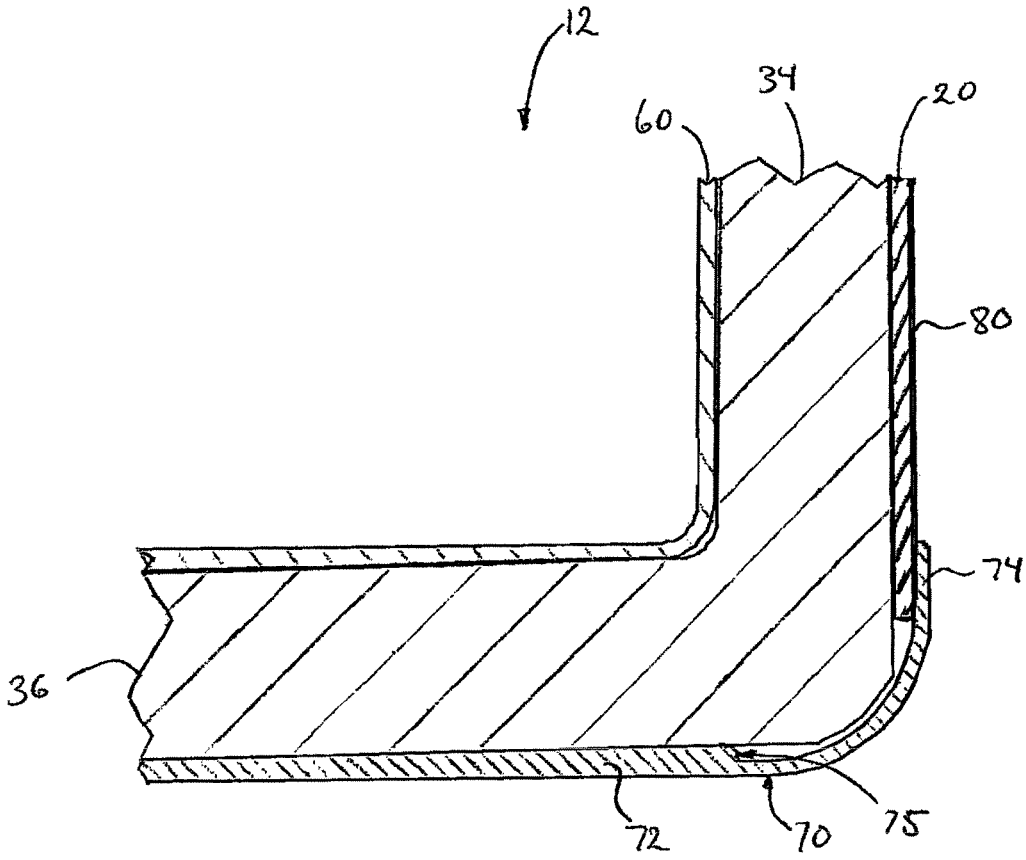
FIG. 4 is a detailed cross-sectional view of the bottom corner of the cooler body of FIG. 1 taken along the line 3-3 according to a further embodiment.

As illustrated in FIG. 4, the bottom cap 70 may optionally include reinforcing ribs 75. The reinforcing ribs 75 may be formed in the planar member 72 of the bottom cap and serve to strengthen the planar member 72 from flexing. The height and placement of the reinforcing ribs 75 may be selected to sufficiently strengthen the cooler body 12 according to methods known in the art.

Figure 6:
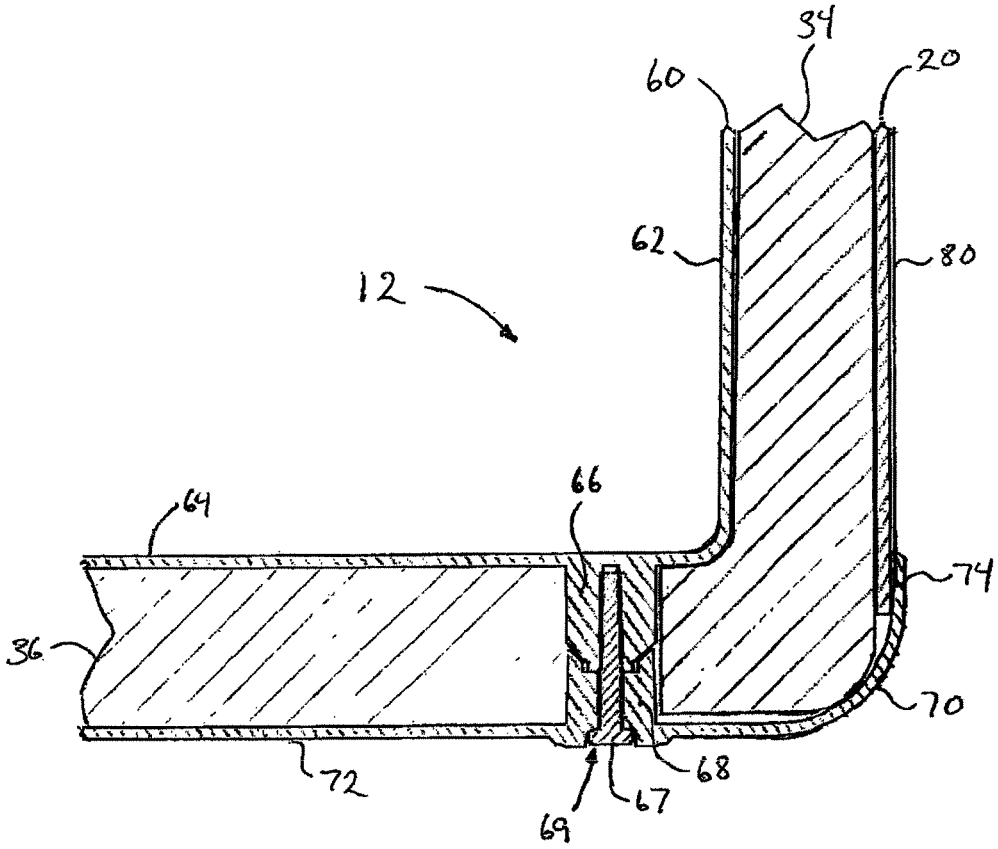
FIG. 6 is a detailed cross-sectional view of the bottom connection detail of the cooler body of FIG. 1 taken along the line 3-3 according to a first embodiment.

Turning now to FIG. 6, the inner liner 60 may be formed having an upright wall 62 extending around the inner compartment 14 with a bottom floor 64. The bottom floor 64 may include a plurality of protuberances 66 adapted to receive and cooperate with screws 67 or other suitable fasteners to secure the bottom cap 70 to the inner liner 60. The bottom cap 70 may include a bore 69 therethrough and an optional reinforced portion 68 for supporting the screw 67 within the bottom cap 70. The size and location of the protuberances 66, screws 67, bores 69 and reinforced portions 68 should be selected to adequately secure the bottom cap 70 to the inner liner 60 according to methods known in the art. It will be appreciated that securing the inner liner 60 to the bottom cap 70 will also assist in retaining the peripheral wall 20 and flexible sheet 80 between the top and bottom caps 40 and 70.

Figure 7:
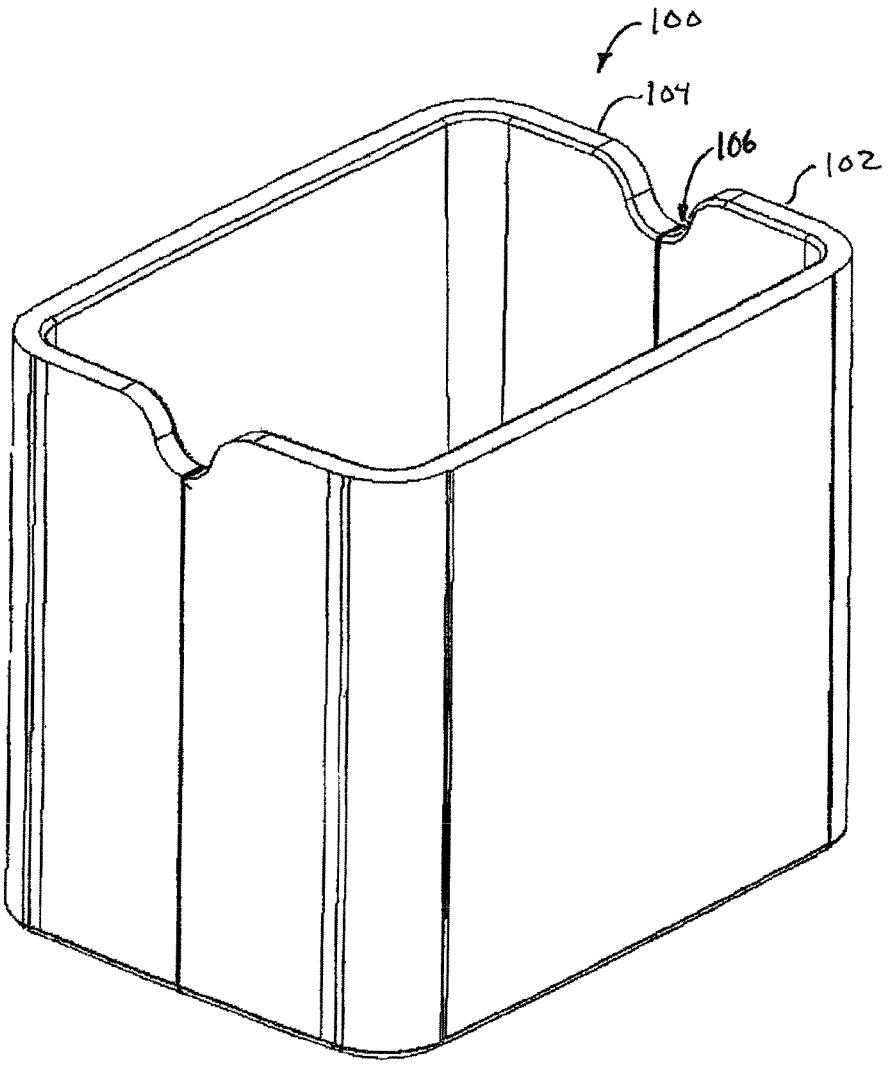
FIG. 7 is a front perspective view of an insulating shell according to an alternative embodiment.
Figure 8:
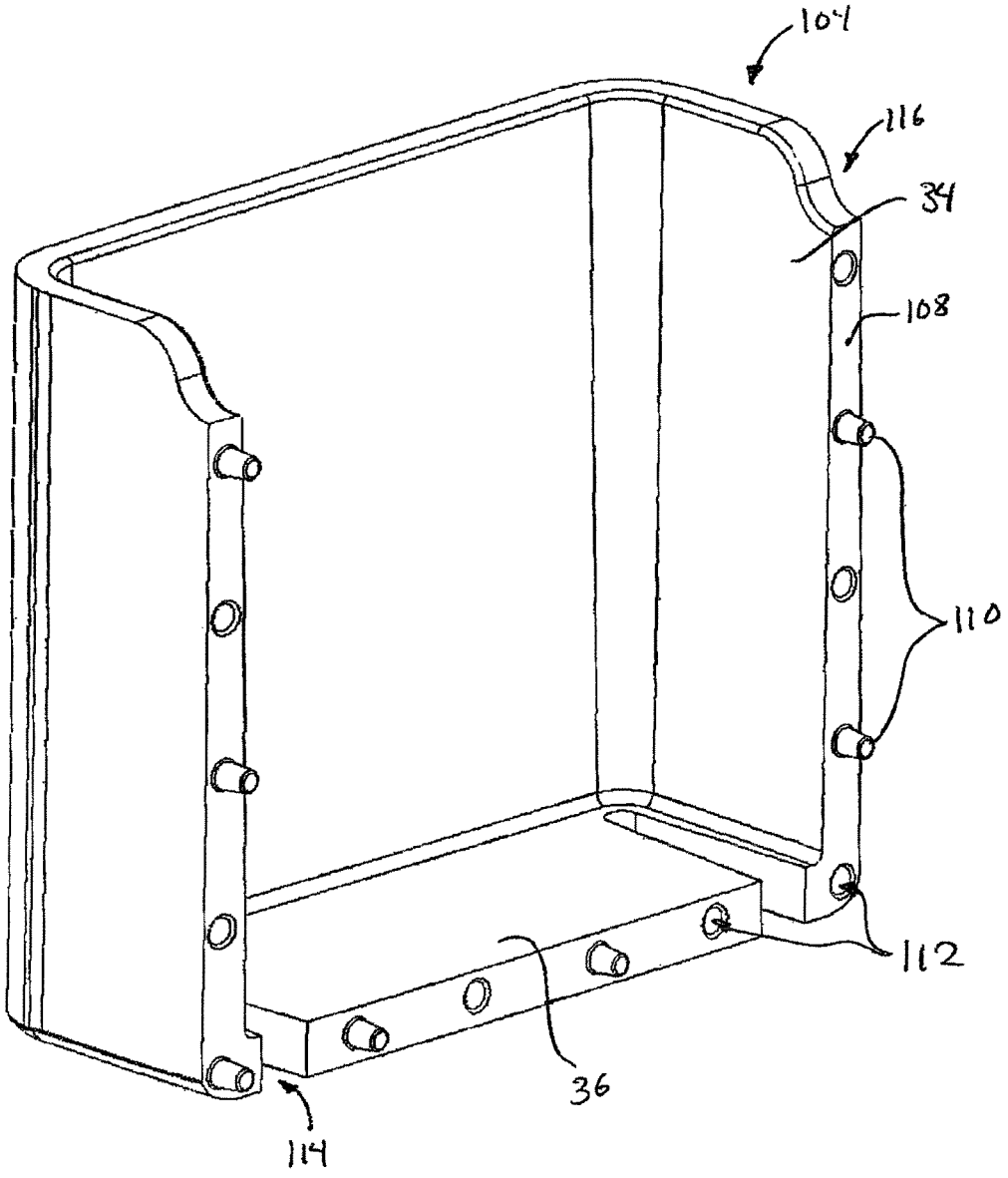
FIG. 8 is a front perspective view of one half of the insulating shell of FIG. 7.

Turning now to FIGS. 7 and 8, one embodiment of a pre-formed insulating shell 100 is illustrated for providing the insulating material 34 as discussed above. The insulating shell 100 may be formed of a first and second shell portion 102 and 104, respectively that are jointed at a midpoint 106 of the insulating shell 100. Although the current description utilizes two shell halves it will be appreciated that a the shell may be formed of more than two shell segments according to similar methods. In addition, it should be appreciated that the shell segments may also be connected at divisions other than the midpoint of the shell as well. As illustrated in FIG. 8, the second shell portion 104 may be formed having a connection edge 108 having a plurality of pins or projections 110 extending therefrom and a plurality of bores 112 therein. The pins 110 of the second shell portion 104 are adapted to align with bores 112 of a corresponding first shell portion 102 to which the second shell portion 104 is to be joined and vice versa. The shell portions may be fastened to each other by known method such as adhesives friction fit or welding, by way of non-limiting example. The pre-formed shell may be formed from any suitable insulating material. In practice, it has been found that polystyrene has been useful.

Figure 9:
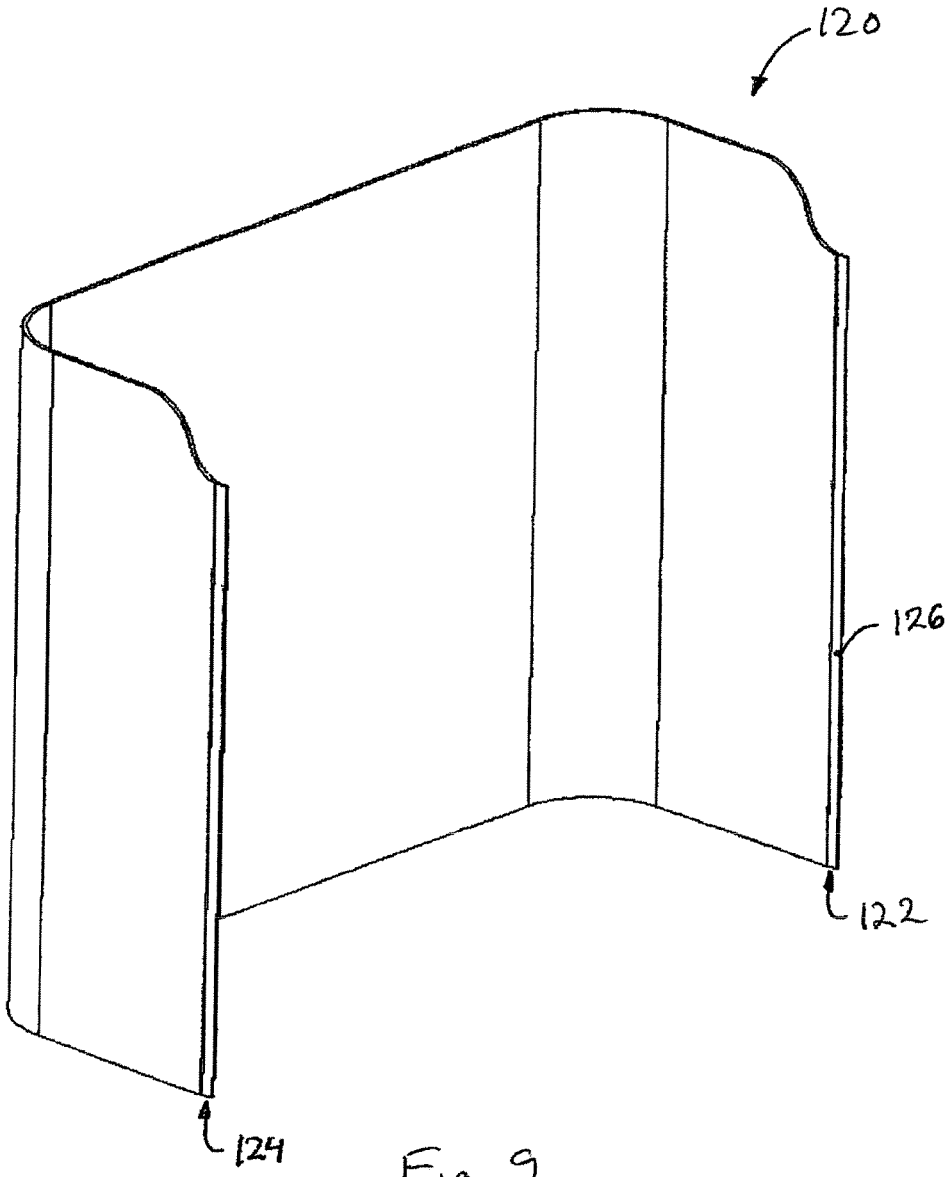
FIG. 9 is a front perspective view of a peripheral wall segment according to an alternative embodiment.
Figure 10:
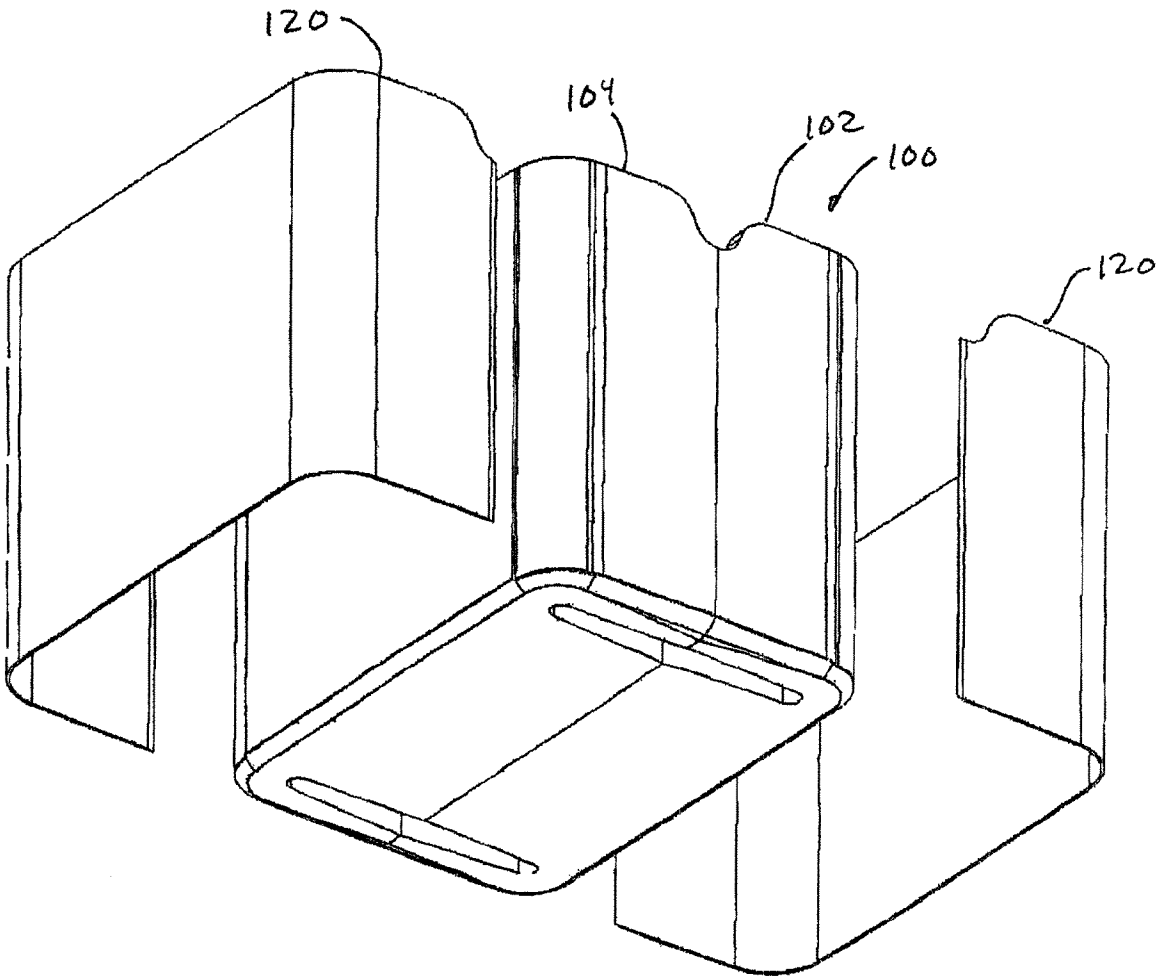
FIG. 10 is a bottom perspective view of two peripheral wall segments of FIG. 9 being applied to the insulating shell of FIG. 7.
Figure 11:
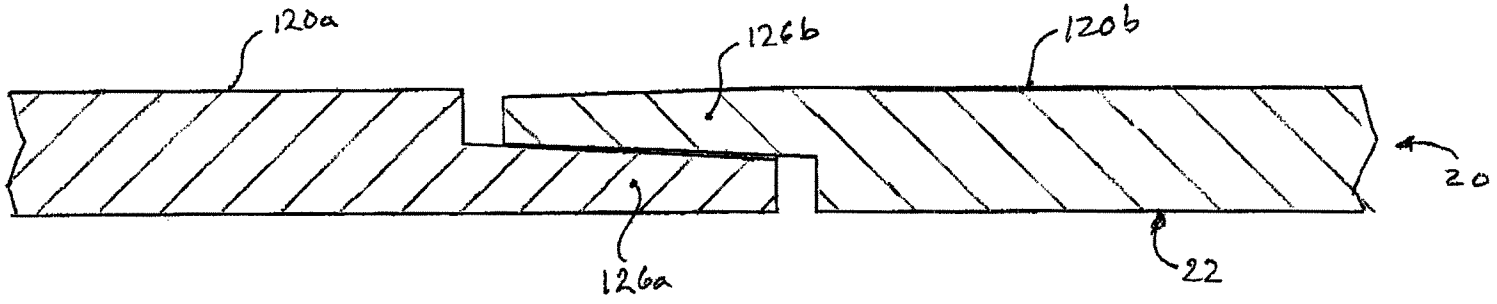
FIG. 11 is a cross sectional view of the connection of two peripheral wall segments of FIG. 9.

As illustrated in FIGS. 9 and 10, the peripheral wall 20 may be formed of a plurality of wall segments 120. As illustrated in FIG. 9, the wall segments may have first and second upright edges 122 and 124, respectively. The first and second edges 122 and 124 may include a step 126 formed therein. The step 126 in opposed wall segments 120 may be adapted to mirror and overlap each other such that a first step 126*a* of a first wall segment 120*a* overlaps only the second step 126*b* of the second wall segment 120*b* as illustrated in FIG. 11. In such an arrangement, the exterior surface 24 of the peripheral wall will be maintained substantially even and regular. As illustrated in FIG. 10 the wall segments 120 may be applied to the insulating shell 100 and bonded thereto by adhesives or the like.

Figure 12:
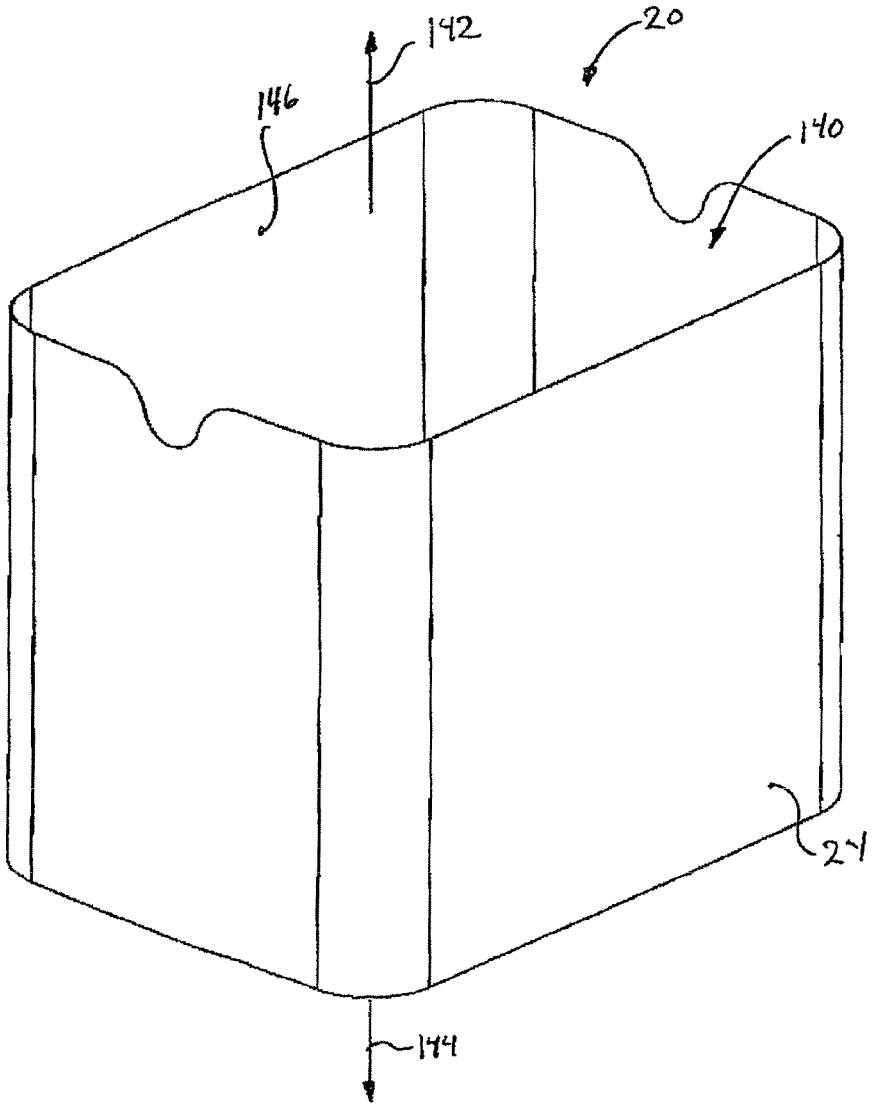
FIG. 12 is a front perspective view of a one piece peripheral wall according to an alternative embodiment.

According to a further embodiment, the peripheral wall 20 may be formed as an integral part as illustrated in FIG. 12. Such single peripheral walls 20 may be formed by injection molding utilizing internal dies to form the interior surface 146 of the peripheral wall and exterior dies to form the exterior surface 24. In such methods, the internal dies may be pulled axially away from the interior 140 of the peripheral wall as indicated by arrows 142 and 144.

Figure 13:
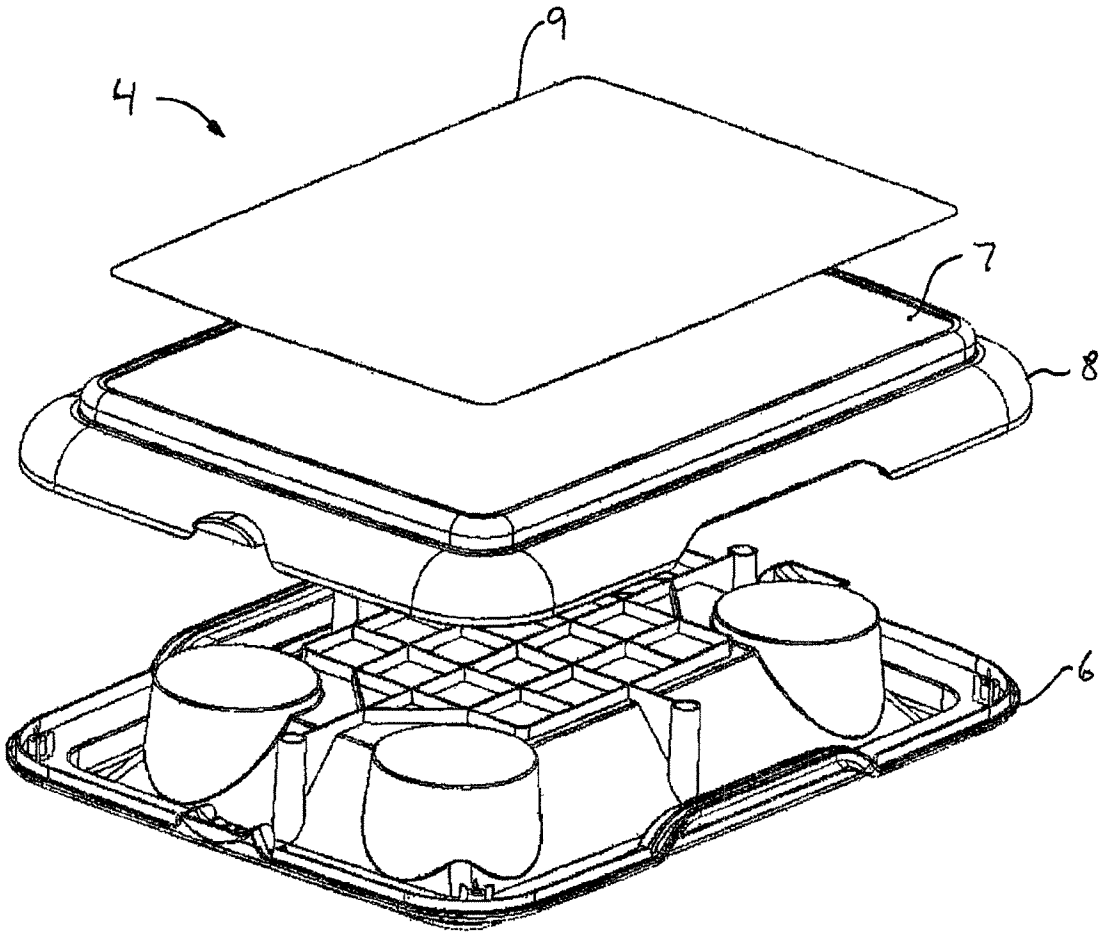
FIG. 13 is a perspective exploded view of the lid of FIG. 1.
Figure 14:
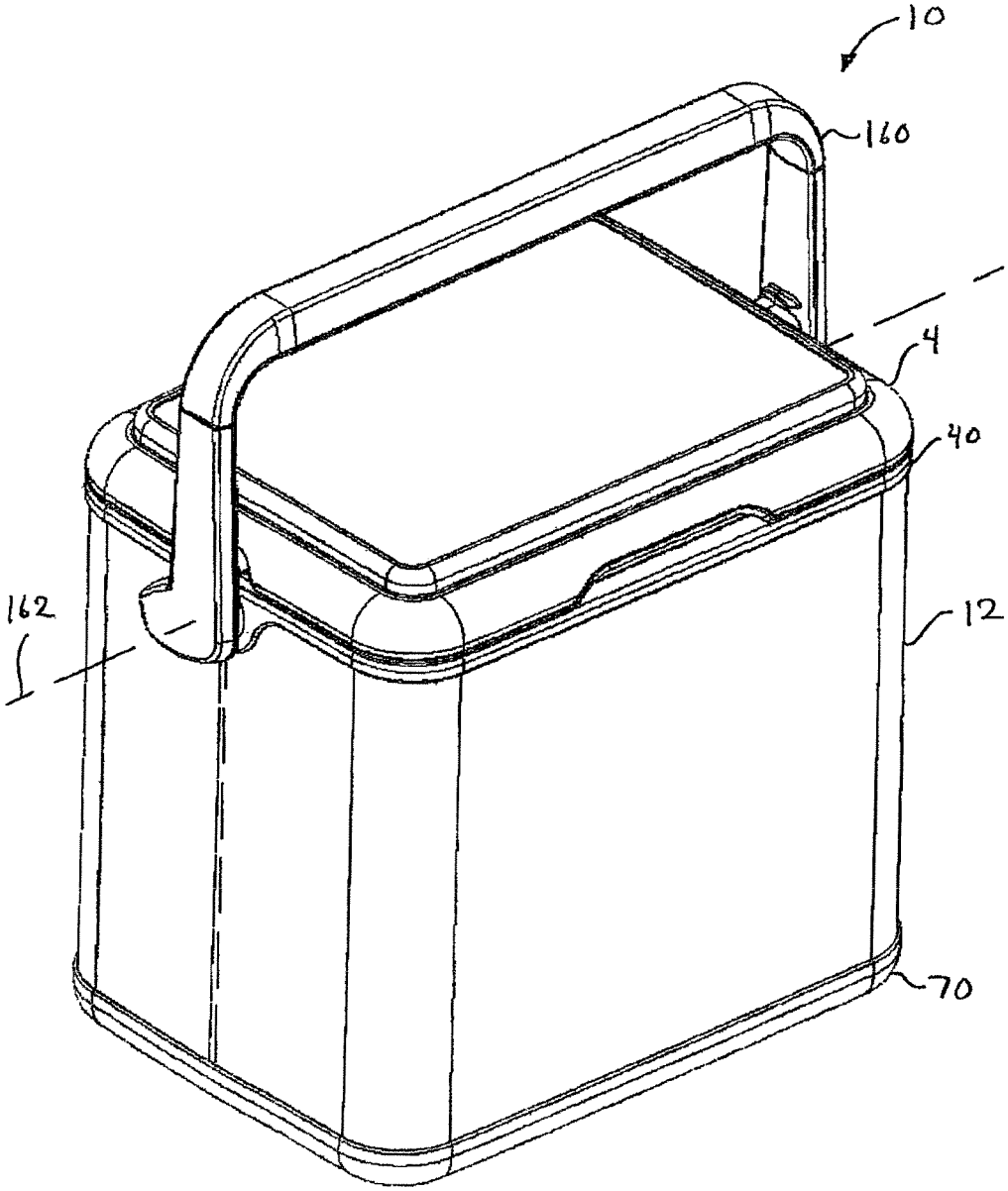
FIG. 14 is a perspective view of a cooler having a handle according to a further embodiment with the lid oriented to have the graphics side exposed.
Figure 15:
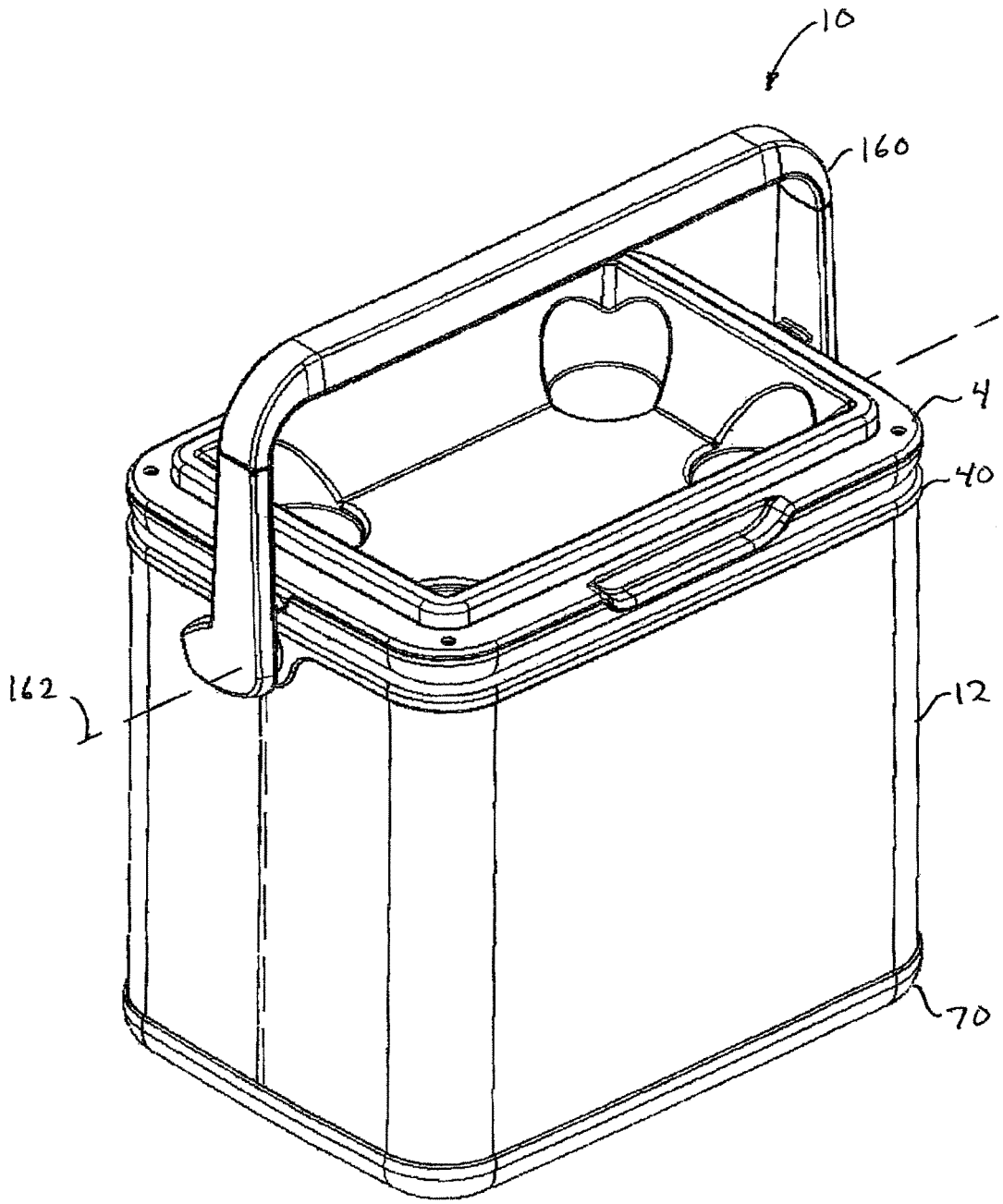
FIG. 15 is a perspective view of the cooler of FIG. 14 with the lid oriented to have the bottom side exposed.
Figure 16:
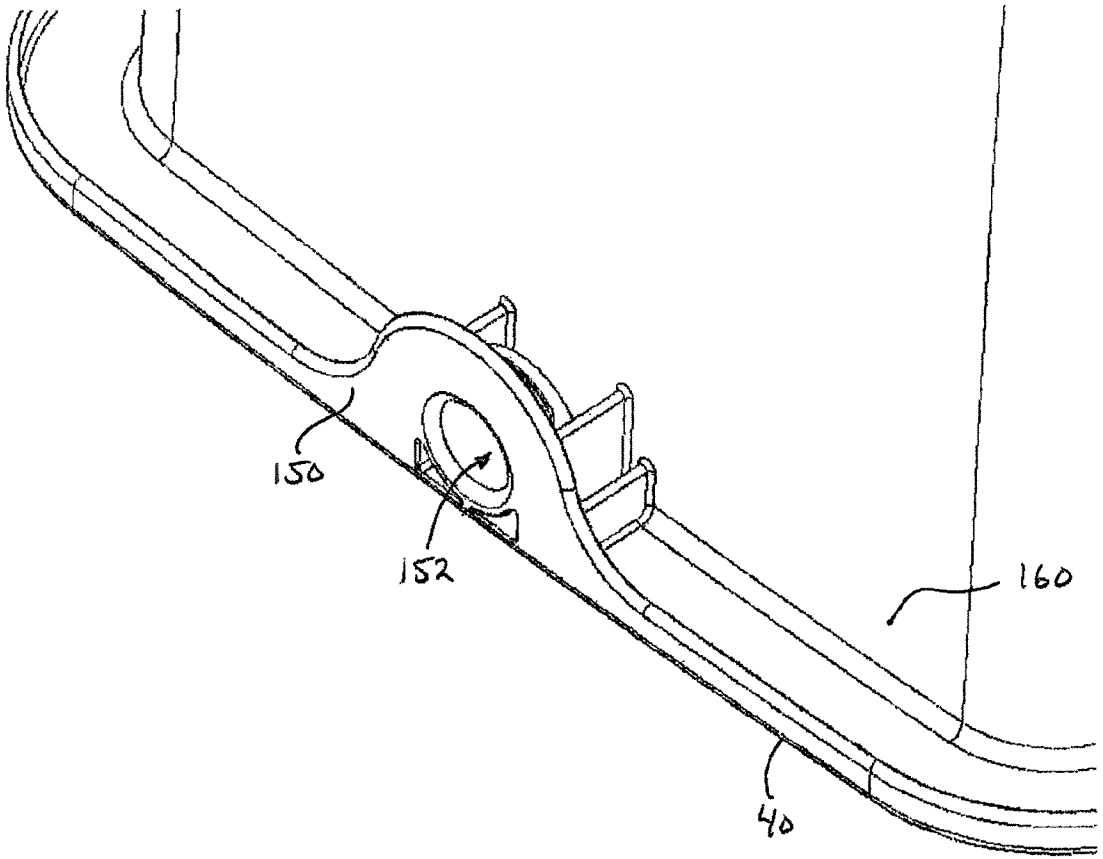
FIG. 16 is a perspective view of the bearing journal for supporting the handle of the Cooler of FIG. 14.

Turning to FIG. 13, the lid 4 may be formed from a top portion, 8 and a bottom portion 6 as is known in the art. The lid 4 may optionally also include an insulating material between the top and bottom portions 8 and 6. A top graphics sheet 9 may also be applied to the top surface 7 of the lid. The cooler 10 may also include a handle 160 as illustrated in FIG. 14 as are conventionally known. The handle may be rotatably secured to the top cap 40 about an axis 162. The lid 4 may optionally be positioned with the graphics sheet 9 exposed as illustrated in FIG. 14 or with the bottom portion 6 exposed as illustrated in FIG. 15. The handle 160 may be secure the lid in either of the positions illustrated as is conventional. As illustrated in FIG. 16, the top cap 40 and the liner 60 may be formed with a bearing body 150 having journals 152 therethrough for rotatably supporting the handle 160.

Figure 17:
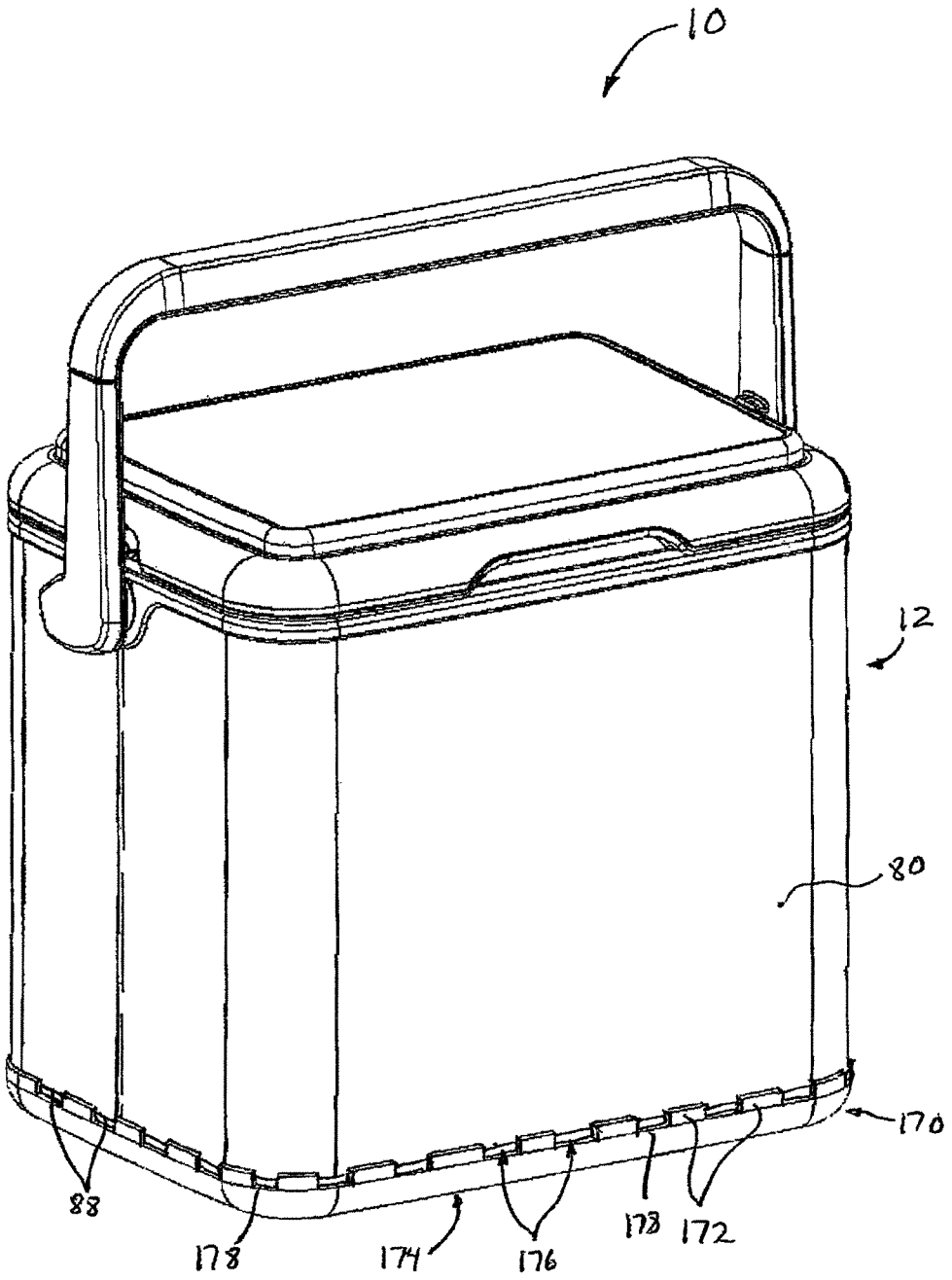
FIG. 17 is a front perspective view of a cooler according to a further embodiment having intermittent graphics edge protection.
Figure 18:
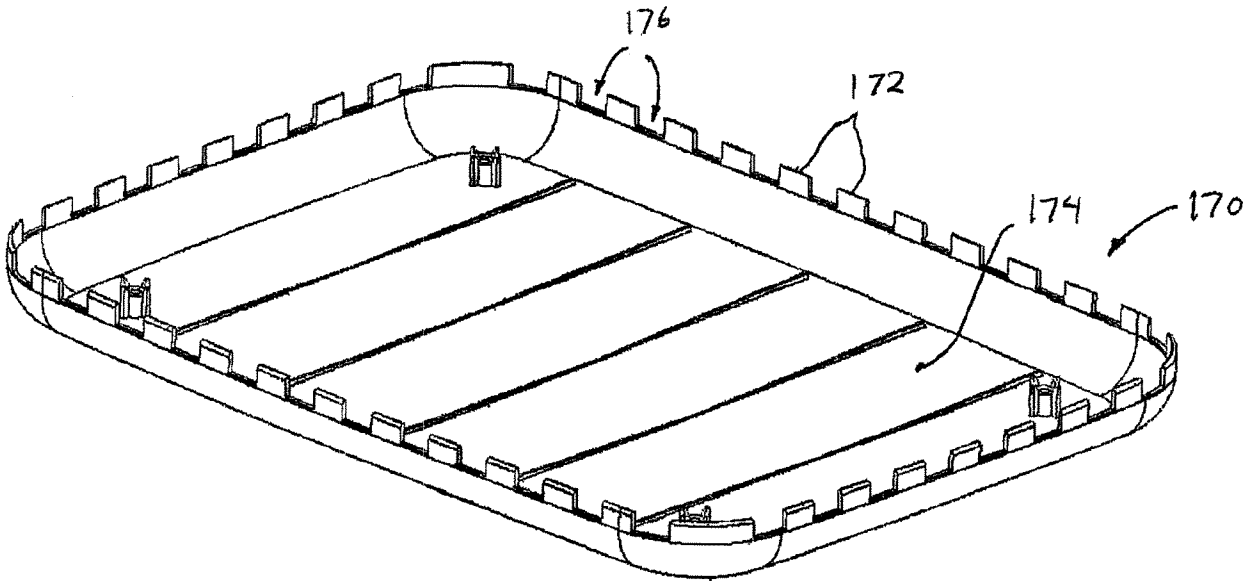
FIG. 18 is a front perspective view of bottom cap of the cooler of FIG. 17.

Turning now to FIGS. 17 and 18, an alternative embodiment is illustrated having segmented or intermittent edge protection for the flexible sheet 80. As illustrated, the cooler body 12 includes a segmented bottom cap 170 having intermittent or discontinuous upturned portions 172. The intermittent upturned portions 172 comprise a plurality of spaced apart wall segments extending from the perimeter of a planar member 174 of the segmented bottom cap 170. As illustrated in FIGS. 17 and 18, the intermittent upturned portions 172 may be substantially rectangular and include rectangular notches 176 therebetween so as to form castellations. It will also be appreciated that in other embodiments, the intermittent upturned portions may have other shapes as well, such as, for example, triangular, sinusoidal, or semi-circular by way of non-limiting example. As illustrated in FIG. 17, the intermittent upturned portions 172 are sized to overlap the bottom edge 88 of the flexible sheet 80. As illustrated the bottom edge 88 of the flexible sheet 80 may be exposed within the notches 176 therebetween although it will be appreciated that an indented edge 178 forming the base of the notches 176 may also overlap the bottom edge 88 of the flexible sheet 80. Although the present embodiment is described with relation to the bottom cap, it will be appreciated that the top cap may also include intermittent downturned portions for overlapping the top edge 86 of the flexible sheet 80.

Figure 19:
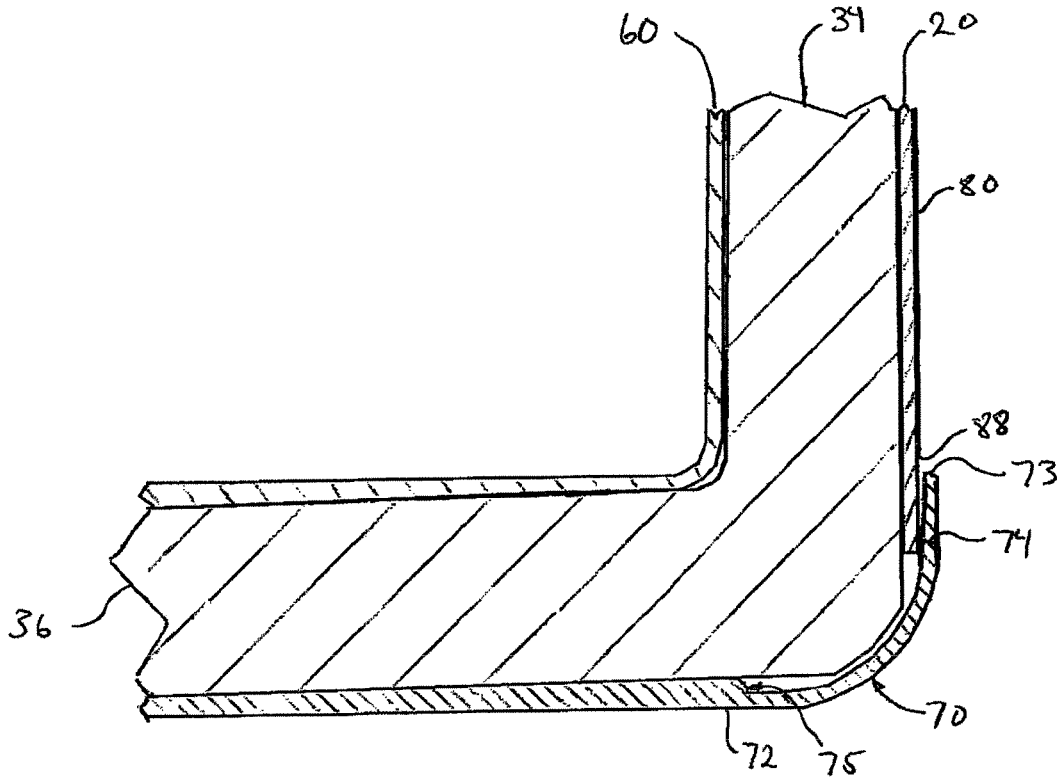
FIG. 19 is a detailed cross-sectional view of the bottom corner of the cooler body of FIG. 1 taken along the line 3-3 according to a further embodiment.

Turning now to FIG. 19, an alternative embodiment is illustrated in which the bottom cap 70 does not overlap the bottom edge 88 of the flexible sheet 80. As illustrated, a top edge 73 of the upturned portion 74 of the bottom cap is proximate to the bottom edge 88 of the flexible sheet so as to protect the bottom edge from being caught and therefore torn or otherwise damaged. In order to properly protect the flexible sheet 80, the top edge 73 of the bottom cap 70 should be located within 5 millimetres of the bottom edge of the flexible sheet so as to prevent objects from passing therebetween in such a manner as to permit them to catch or hook the bottom edge of the flexible sheet. It will be appreciated that the top cap 40 may similarly also be proximate to without overlapping the top edge 86 of the flexible sheet 80.

Figure 20:
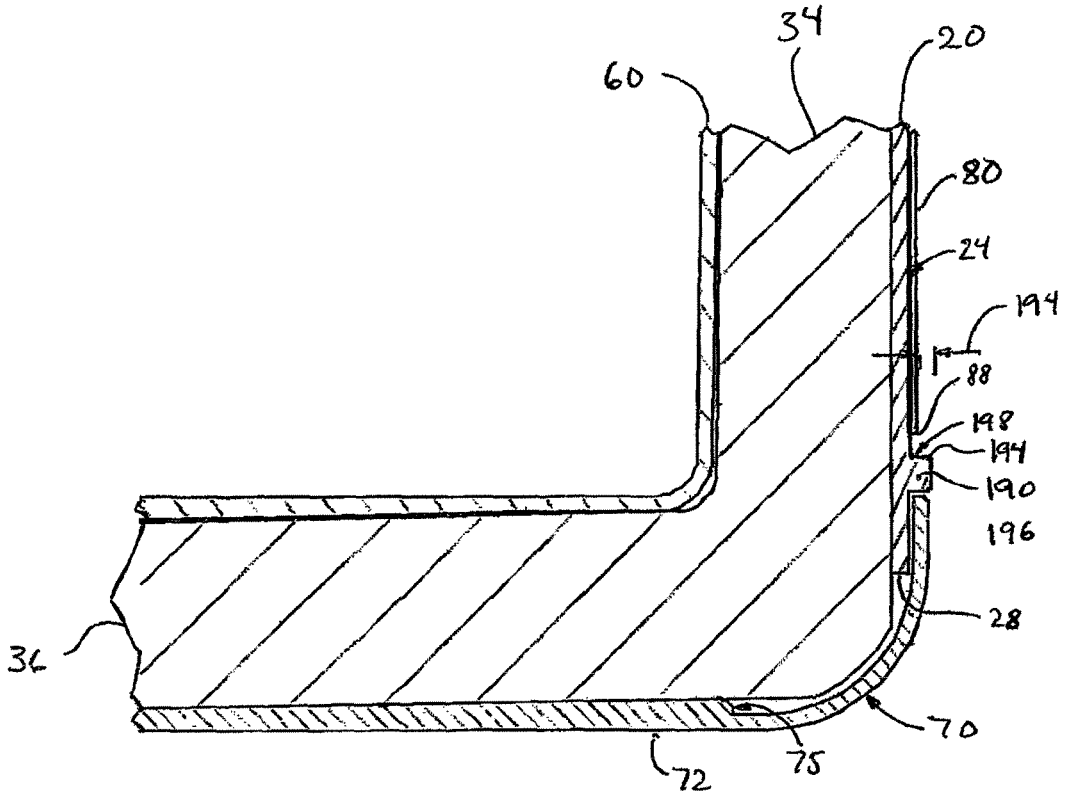
FIG. 20 is a detailed cross-sectional view of the bottom corner of the cooler body of FIG. 1 taken along the line 3-3 according to a first embodiment.

According to a further embodiment, the peripheral wall 20 includes a raised portion 190 located proximate to the bottom edge 28 of the peripheral wall as illustrated in FIG. 20. The raised portion 190 comprises a protuberance from the peripheral wall 20 and includes a top surface 194 forming an inside angle 198 with the exterior surface 24 of the peripheral wall 20. The inside angle 198 should have a substantially sharp radius such that the bottom edge 88 of the flexible sheet 80 may be located proximate to the top surface 194 of the raised portion. In order to properly protect the flexible sheet 80, the bottom edge 88 of the flexible sheet should be locatable within 5 millimetres of the top surface 194 of the raised portion 190 so as to prevent objects from passing therebetween in such a manner as to permit them to catch or hook the bottom edge of the flexible sheet. The raise portion 190 should also project from the flexible sheet 80 when applied to the peripheral wall by a distance sufficient to protect the flexible sheet as indicated generally at 192. It has been found that a projection of at least 2 millimetres has been sufficient although it will be appreciated that other distances may be useful as well. The peripheral wall may include a shoulder 196 adapted to receive the bottom cap 70 between the raised portion 190 and the bottom edge 28 of the peripheral wall 20.

While specific embodiments have been described and illustrated, such embodiments should be considered illustrative only and not as limiting in accordance with the accompanying claims.

What is claimed is:

1. An apparatus for storing articles comprising:

a) an insulated food storage container defining an interior compartment, the container having an open top, a closed bottom, a sealable and openable lid covering the open top of the interior compartment, and a continuous peripheral wall extending therearound between said top and bottom, said peripheral wall having a substantially flat exterior surface, b) a flexible sheet having top and bottom opposed edges, the flexible sheet applied to the outer peripheral wall of the container;

c) the flexible sheet having a viewable graphic image applied thereto so as to be viewable while the container is in use;

d) said exterior surface being adapted to have said flexible sheet applied thereto, and e) wherein the continuous peripheral wall of the container provides an edge protector which overlies at least a portion of said top or bottom edge of said flexible sheet for protecting edge of said flexible sheet leaving a center portion of said flexible sheet uncovered and viewable.

2. The apparatus of claim 1 wherein said peripheral wall has opposed top and bottom edges, said apparatus further comprising at least one cap adapted to engage with one of said top or bottom edge of said peripheral wall wherein said at least one cap includes said edge protector.

3. The apparatus of claim 2 wherein said edge protector of said at least one cap is adapted to overlap at least a portion of said one of said top or bottom edge of said flexible sheet when said at least one cap is engaged with said peripheral wall.

4. The apparatus of claim 3 further comprising a bottom cap adapted to engage said bottom edge of said peripheral wall and a top cap adapted to engage said bottom edge of said peripheral wall such that said edge protector of said bottom cap is adapted to overlap at least a portion of said bottom edge of said flexible sheet and said edge protector of said top cap is adapted to overlap at least a portion of said top edge of a flexible sheet applied to said peripheral wall.

5. The apparatus of claim 3 wherein said edge protector is adapted to overlap said at least one of said top or bottom edge of said flexible sheet around a circumference of said container.

6. The apparatus of claim 5 wherein said edge protector comprises a wall extending from said at least one cap and is adapted to surround said container body in parallel to said peripheral wall.

7. The apparatus of claim 5 wherein said edge protector comprises a plurality of fingers extending from said at least one cap wherein said plurality of fingers are adapted to overlap said top or bottom edge of said flexible sheet.

8. The apparatus of claim 2 wherein said at least one cap is adapted to have an edge located proximate to said at least one of said top or bottom edge of said flexible sheet when applied to said peripheral wall, said cap being adapted to project outwardly from said peripheral wall farther than said flexible sheet.

9. The apparatus of claim 1 wherein said edge protector comprising a raised portion of said peripheral wall located adjacent to said at least one of said top or bottom edge of said flexible sheet so as to project past said flexible sheet.

10. The apparatus of claim 1 further wherein, said flexible sheet comprises inner and outer surfaces and top and bottom opposed edges corresponding to said top and bottom of said container such that at least one of said top or bottom edges of said flexible sheet is proximate to a corresponding top or bottom of said container.

11. The apparatus of claim 10 wherein said flexible sheet is sized such that said bottom edge of said flexible sheet is proximate to a bottom edge of said peripheral wall and said top edge of said flexible sheet is proximate to a top edge of said peripheral wall when applied thereto.

12. The apparatus of claim 10 wherein said flexible sheet is adapted to substantially surround said peripheral wall when applied thereto.

13. The apparatus of claim 10 wherein said flexible sheet further comprises a plurality of flexible sheet segments adapted to cooperate so as to circumferentially surround said peripheral wall.

14. The apparatus of claim 10 wherein said inner surface of said flexible sheet includes an adhesive for application to said exterior surface of said peripheral wall.

15. The apparatus of claim 10 wherein said flexible sheet comprises a substantially transparent material, wherein said flexible sheet further comprises a graphic applied to said inner surface operatively configured to be viewed from said outer surface.

16. The apparatus of claim 15 wherein said graphics are printed onto said flexible sheet.

17. The apparatus of claim 1 wherein said top and bottom of said container are parallel to each other wherein said peripheral wall extends perpendicularly therebetween.

18. The apparatus of claim 1 wherein said top cap further includes a liner adapted to define an interior cavity of said container.

19. The apparatus of claim 18 further comprising an insulating layer between said liner and said peripheral wall.

20. The apparatus of claim 1 further comprising:

a) a bottom cap forming the closed bottom of the container;

b) wherein the bottom cap further comprises an upturned portion integral to the bottom cap; and c) wherein the upturned portion forms the edge protector.

21. The apparatus of claim 1 wherein the insulate food storage container is comprised of:

a) an inner liner having an inner surface defining the interior compartment and an outer surface; and b) a thermally insulating material disposed between the outer surface of the inner liner and the peripheral wall.

* * * * *